US005307866A

United States Patent [19]

Weigel

[11] Patent Number: 5,307,866

[45] Date of Patent: May 3, 1994

[54] APPARATUS FOR CLEANING THE INSIDE OF PIPES IN A HEAT EXCHANGER

[76] Inventor: Bernd Weigel, Im Weingarten 3, 8744 Mellrichstadt, Fed. Rep. of Germany

[21] Appl. No.: 49,256

[22] Filed: Apr. 20, 1993

Related U.S. Application Data

[63] Continuation-in-part of Ser. No. 852,139, Apr. 29, 1992, abandoned.

[30] Foreign Application Priority Data

Sep. 12, 1989 [DE] Fed. Rep. of Germany ..... 3930493

[51] Int. Cl.[5] ..... F28G 1/16

[52] U.S. Cl. ..... 165/95; 122/391; 134/167 C

[58] Field of Search ..... 165/95; 122/391; 134/166 C, 166 R, 167 C

[56] References Cited

U.S. PATENT DOCUMENTS

| | | | |
|---|---|---|---|
| 3,814,330 | 6/1974 | Masters | 134/167 C X |
| 3,938,535 | 2/1976 | Cradeur et al. | 134/167 C |
| 4,705,107 | 11/1987 | Council et al. | 15/104.12 X |
| 4,820,496 | 4/1989 | Sapoff | 134/167 C X |
| 4,896,686 | 1/1990 | Schmidt, Jr. et al. | 134/167 C |
| 5,022,463 | 7/1991 | Boisture | 165/95 |

FOREIGN PATENT DOCUMENTS

| | | | |
|---|---|---|---|
| 55700 | 7/1982 | European Pat. Off. . | |
| 159200 | 10/1985 | European Pat. Off. . | |
| 2443293 | 7/1980 | France . | |
| 162900 | 7/1987 | Japan | 165/95 |
| 821905 | 4/1981 | U.S.S.R. | 165/95 |
| 1074900 | 7/1967 | United Kingdom . | |

*Primary Examiner*—John Rivell
*Assistant Examiner*—L. R. Leo
*Attorney, Agent, or Firm*—Edwin D. Schindler

[57] ABSTRACT

An apparatus for cleaning the inside of pipes in a heat exchanger is disclosed, which includes an aggregate having the provision of high-pressurized water and, at least, one hose leading from said aggregate for directing the high-pressurized water. The hose is wound around a reel or a retractable feeding device in the aggregate when in a non-operational mode. An operating tube for at least partially containing the hose and being suitable for handling during operation by a user and for directing the high-pressurized water emitted from the hose is further provided. A flexible guide hose is located between the reel of the aggregate and the operating tube with a mounting device for fixing the operating tube in all directions on a frontal side of, at least, one pipe of the heat exchanger allows for a convenient and safe operation by personnel.

7 Claims, 5 Drawing Sheets

FIG.3
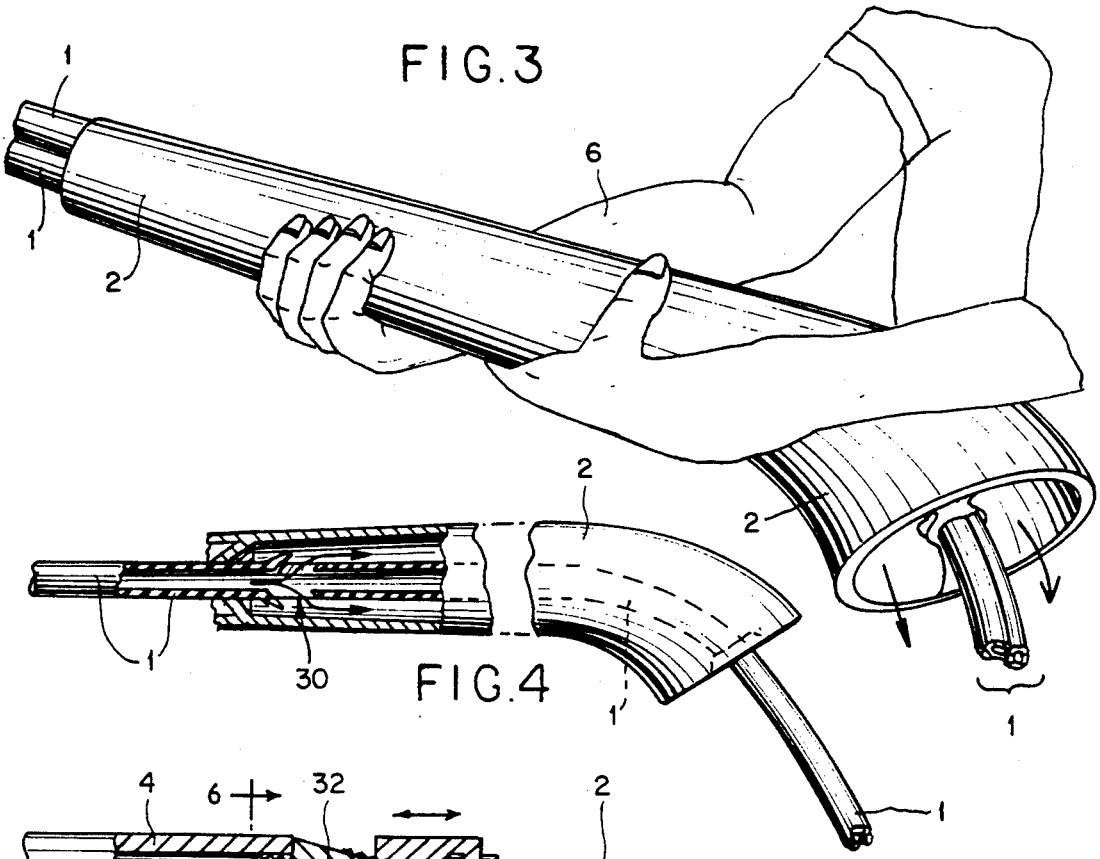
FIG.4
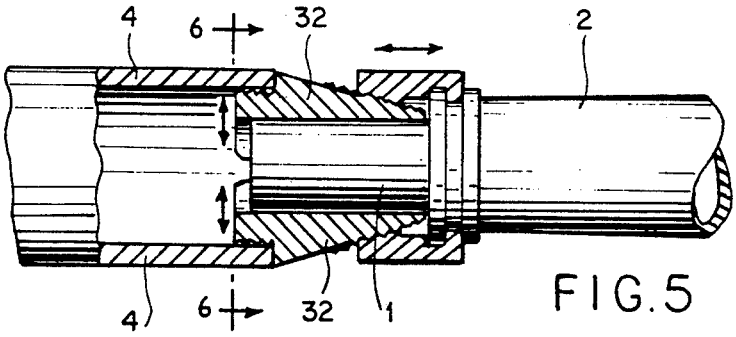
FIG.5
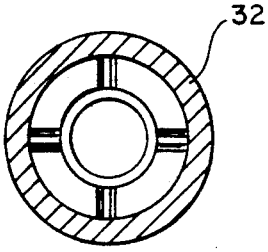
FIG.6

APPARATUS FOR CLEANING THE INSIDE OF PIPES IN A HEAT EXCHANGER

CROSS-REFERENCE TO RELATED APPLICATION

This application is a continuation-in-part of application Ser. No. 07/852,139, filed Apr. 29, 1992, now abandoned.

BACKGROUND OF THE INVENTION

1. Technical Field of the Invention

The present invention relates to an apparatus for cleaning the inside of pipes in a heat exchanger. More particularly, the present invention relates to an apparatus for cleaning the inside of pipes in a heat exchanger having an aggregate for the provision of high-pressure water and, at least, one hose leading outward which is partially wound around a reel.

2. Description of the Prior Art

In most varied sectors of technology, primarily, though not exclusively, in the operation of oil and chemical refineries, chemical and petrochemical plants, etc., heat exchangers find application wherein a medium of one temperature flows through bundles of pipes which are surrounded by a medium having a differing temperature. With lengthening service life, a coating is deposited onto the interior of the pipes which causes performance to decrease and, in extreme cases, can fully impede circulation within the pipes.

Accordingly, from time to time, the inside of the pipes must inevitably be cleaned. In the case of heat exchangers which may be dismantled and transported, a cleaning procedure is executed at a central location, usually in a partially or fully automated manner, with cleaning units which work with high-pressure lances. By contrast, in the case of stationary heat exchangers, in situ cleaning must be executed manually, either by means of high-pressure lances or, as is often the case, with the aid of hoses through which high-pressure water is fed.

A decisive disadvantage may be recognized in the danger inherent for operating personnel, e.g., when the high-pressure hose shoots water back because of clogged pipes, the pressurized water escapes and can cause serious injury to operating personnel which may not be easily treatable. Moreover, proper operation of such prior art apparatus by service personnel still subjects the personnel to extreme physical strain.

SUMMARY OF THE INVENTION

It is, therefore, an object of the present invention to provide an apparatus for cleaning the inside of pipes of a stationary heat exchanger which allows operating personnel to work with greater safety than comparable prior art cleaning apparatuses.

It is a further object of the present invention to overcome the disadvantages inherent in prior art devices.

The foregoing and related objects are achieved by the claimed apparatus for cleaning the inside pipes of heat exchangers, which includes the provision of a hose carried in an operating tube; said operating tube being suitable for handling. The hose is retractable via a feeding device disposed proximately to an aggregate and/or reel with a flexible guide hose being located between the reel and the operating tube. A mounting device fixes the operating tube in all possible directions. In addition, the hose is preferably provided with either outlet nozzles pointing backwards or, in the vicinity of the operating tube, with a second feeding device which is directed outwardly.

The inside of the pipes of a heat exchanger is able to be cleaned by inserting the front end of the hose into the interior space of the pipe so that the pressurized water discharged through the nozzles blasts the deposits from the walls of the pipe. Two alternatives are possible for drawing the hose inward: In a first embodiment, the outlets nozzles are directed backwards—i.e., pointing toward the inlet end of the pipe. This arrangement has the effect that the pressurized water being discharged causes the inserted hose to draw itself into the pipe and, further, that the deposits already broken free from the interior of the pipe are able to be washed out without hindering the advance of the hose. Alternatively, in a second embodiment, if the outlet nozzles are oriented differently, e.g., radially or forwards, an additional feeding device is required in the region of the operating tube for insertion. Generally, a hose may only be subjected to tensile stress. It is, therefore, preferable to wash out the loosened deposits at the opposite end of the pipe. The withdrawal of the hose, necessary after completing the cleaning process, is achieved via an additional feeding device, e.g., in the form of a driven reel which effects a rolling up of the hose. In order to rule out any kind of danger for the operating personnel, the hose is carried in an operating tube and guide hose. Axial movement is adjusted by operating the feeding device and/or by controlling the water flowing through.

The functioning of the apparatus of the present invention is as follows:

The aggregate as a constituent part of the apparatus of the claimed invention is positioned in the region of the heat exchanger that is to be cleaned and connected up. The operating personnel finds a safe place to position himself or herself at the frontal end of the heat exchanger. Particularly, in the case of heavy soiling, the entrance port of the pipe is subsequently cleaned with the end of the hose being inserted into a pipe and drawn into the pipe through recoil as the pressurized water is switched on or, alternatively, by means of the feeding device. The operating tube positions and fixes the hose in place. Upon completion of the cleaning, the hose is withdrawn using the feeding device. A working length which may be set in advance causes the hose to be fed inward. Thereafter, the feeding device may later be activated and the withdrawal of the hose effected. The most simplistic construction and operation of the invention is achieved if switches belonging to the aggregate conveying the water, as well as the feeding device, are disposed in the region of the operating tube.

The advantages include a safe working environment for operating personnel and the possibility of operation by one person in certain cases.

In a further embodiment of the present invention, the operating tube includes, in one hose or a plurality of hoses, a mounting device which allows fastening to the front of the pipes. As work is commenced, the mounting device is fastened to a pipe other than the one intended for cleaning. The mounting device permits front-end attachment at a certain, fixed distance from the front of the pipes comprising the heat exchanger so that water flowing backwards can drain away trouble-free. The mounting device allows performance to be improved and a full utilization of energy from the aggregate, as the high recoil forces which occur because of the water jet are absorbed by the heat exchanger itself, and can be diverted, which relieves strain on the operating personnel.

Preferably, the mounting device includes a straddling dowel which is inserted into one of the pipes as work is started and affixed there. Only then is cleaning work commenced by introducing the hose. For safety reasons, the work function can be concluded, provided that the mounting device has not been activated.

Of ergonomic advantage is a pistol design for the operating tube which includes two handles, each of which has a push button with a spring-loaded return, which when activated controls the aggregate, the feeding device or the mounting device.

In a preferred embodiment of the invention, the location of a plurality of hoses in the operating tube may be parallel to one another. Such an arrangement permits not only successive, but also the simultaneous cleaning of a plurality of pipes when the corresponding number of hoses are inserted. The spacing of these plurality of hoses in the operating tube must, of course, correspond to the spacing of the pipes in the heat exchanger. Owing to the varying distances, in a further modification, it is recommended that the distances between the plurality of hoses in the operating tube be capable of variation relative to one another.

Because the deposits to be removed from the interior of the pipes of the heat exchanger are on the inside of the pipe, to intensify the cleaning procedure, the distance between the outlet nozzle and the interior wall of the pipe should be as low as possible (whereby the remaining volume inside the pipe is also minimal), the inside diameter of the pipe should be selected to be somewhat large than the outside diameter of the outlet nozzle. To achieve an optimum cleaning effect, the matching of the diameter of the nozzle to the pipe is, therefore, advantageous and preferred.

Handling and changing from one pipe to another is especially easy if the operating tube is supported by a balancer, which is understood to mean a device which supports the operating tube as it regards its weight and which is always aligned parallel to the axis of the pipes. This makes insertion substantially easier and operating personnel need apply only minimal force.

Depending upon the application, from time to time, heat exchangers and the deposits found therein evolve gases or vapors which may be explosive. To avoid igniting these gases during the cleaning process through the feeding devices and to avoid triggering explosions, it is advantageous to drive and operate such devices pneumatically.

Other objects and features of the present invention will become apparent when considered in conjunction with the accompanying drawing figures which discloses preferred embodiments for constructing and operating the apparatus according to the present invention. It should, however, be recognized that the accompanying drawing figures are intended to illustrate preferred embodiments of the invention and are not intended as defining the limits and scope of the invention.

BRIEF DESCRIPTION OF THE DRAWING FIGURES

In the drawing, wherein similar references numerals denote similar features throughout the several views;

FIG. 1 presents a schematic representation of the apparatus of the present invention in an operating mode;

FIG. 3 is a prospective view of the operating tube of the present invention with a plurality of hoses being disposed therein;

FIG. 4 is an elevational view, in partial cross-section, showing the operating tube of the present invention with a single hose disposed therein and means for a backward flow of fluid, the operating tube being formed with a pistol-shaped handle;

FIG. 5 is an elevational view, in partial cross-section, of the operating tube of the present invention having a chuck for mounting the operating tube onto the front inlet of a pipe of a heat exchanger for cleaning the interior thereof;

FIG. 6 is a cross-sectional view of the chuck of FIG. 5 taken along the 6—6 line showing the chuck to be comprised of various struts, rather than as a solid element;

Figure 8:
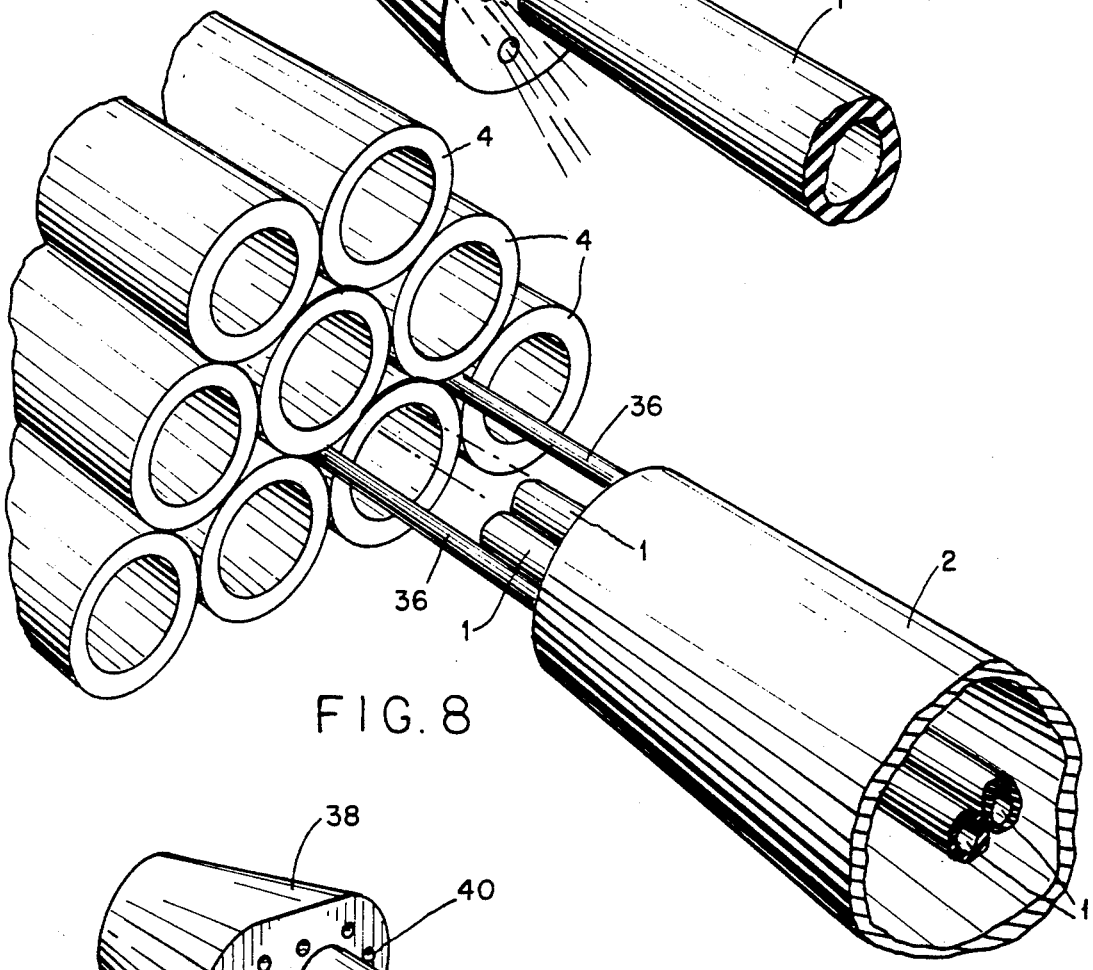
Figure 9:
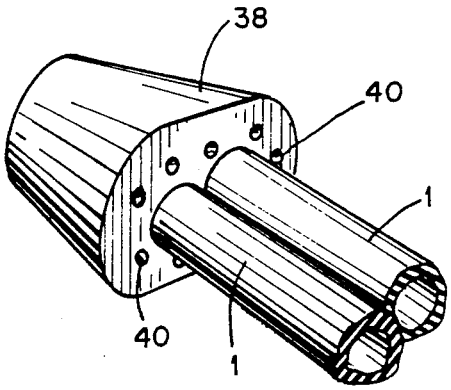

FIG. 8 is a prospective view of the operating tube of the present invention having within it a plurality of hoses and a plurality of straddling dowels for securing the operating tube and hoses relative to the pipes of the heat exchanger to be cleaned; and, FIG. 9 is a prospective view of an outlet nozzle for retaining a plurality of hoses with the nozzle having a construction which permits a backward flow.

DETAILED DESCRIPTION OF THE DRAWING FIGURES AND PREFERRED EMBODIMENTS

Figure 1:
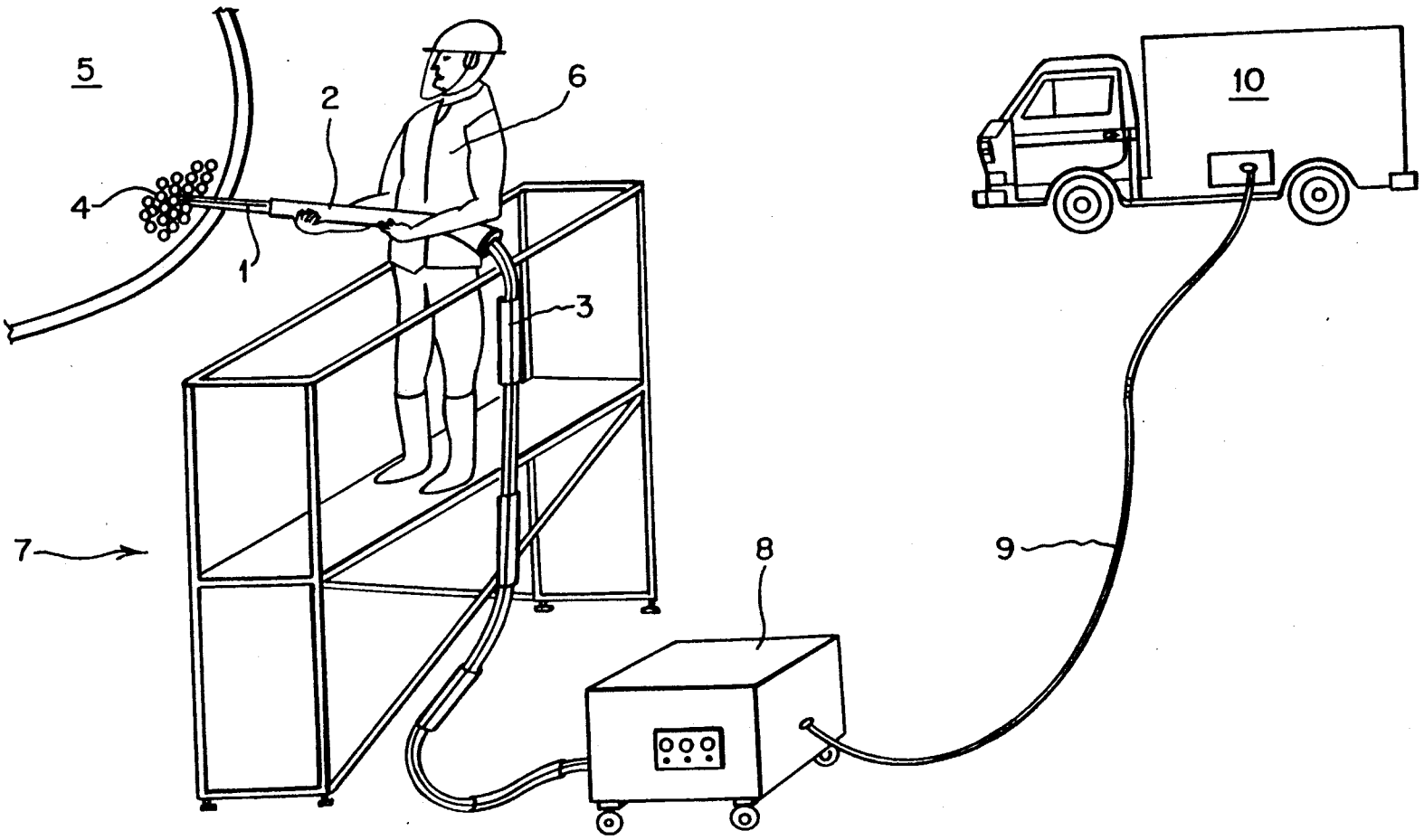

Turning now, in detail, to a detailed analysis of the drawing figures, FIG. 1 provides a schematic representation of the apparatus of the present invention, wherein hose (1) is carried in operating tube (2) and, otherwise, in guide hose (3). Operating hose (2) is held manually and inserted successively into the individual pipes (4) of heat exchanger (5). For this purpose, an operator (6) is shown on scaffolding (7), which permits access from the front of heat exchanger (5).

Figure 2:
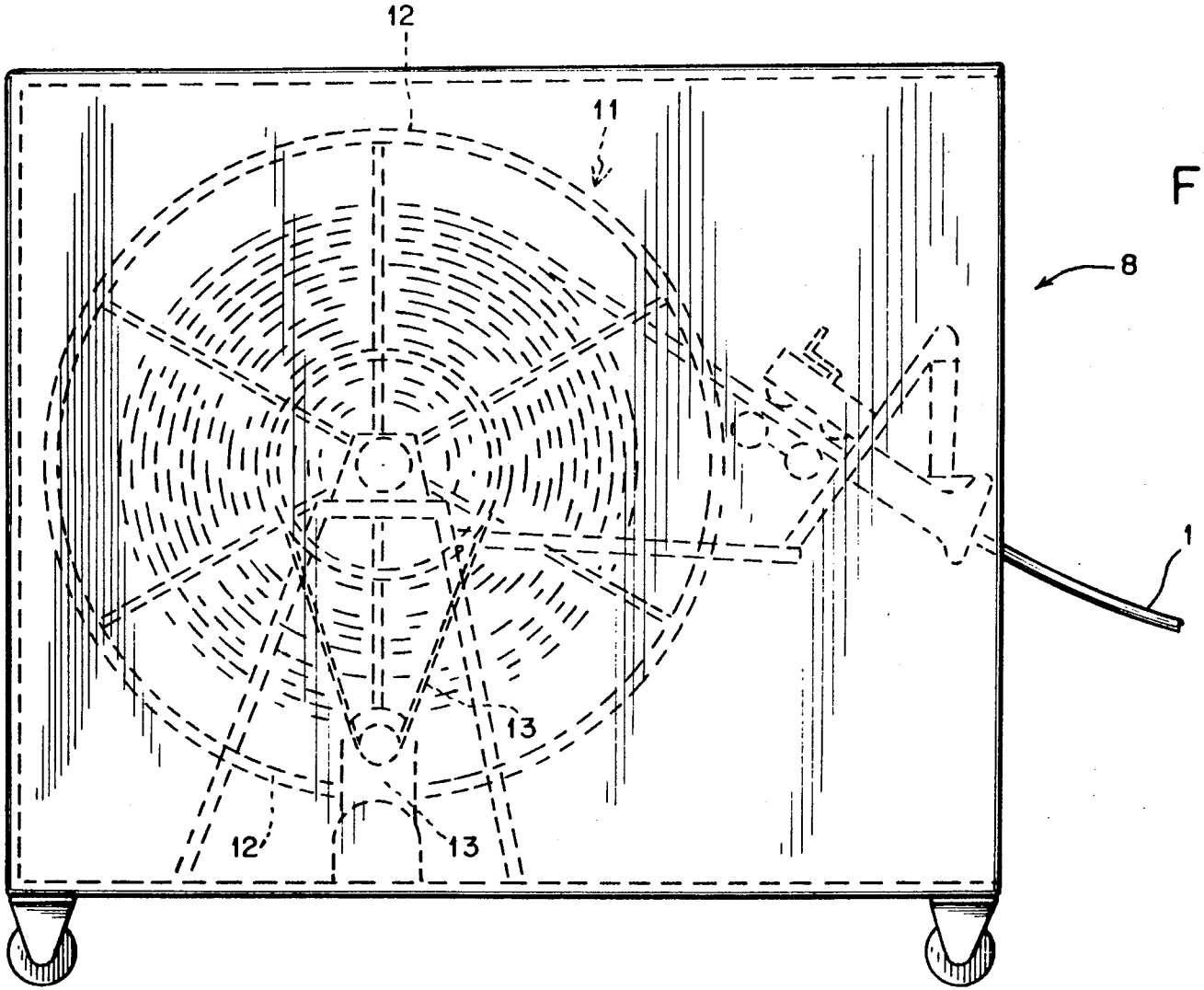
FIG. 2 is an elevational view, presented in phantom, of a retractable feeding device for use as a part of the present invention.

The opposite end of hose (1) extends for a box unit (8) which includes a feeding device (11), of the type generally represented by FIG. 2, for retracting said hose (1), as well as a reel (12), having associated drive means, or biasing means (13). Feeding device (11) is constructed so that it is able to provide for sufficiently pressurized water, while also providing for the eventual retraction of hose (1) aided by the feeding device that preferably moves the hose through the feeding device by a pulling action.

In a preferred embodiment of the invention, box unit (8) is supplied with a conventional energy source from a motor vehicle (10) via power line (9).

Figure 2B:
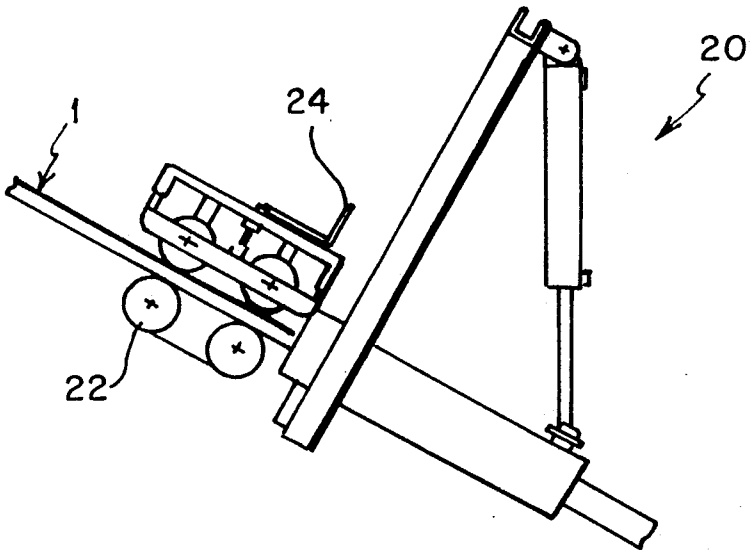
FIG. 2B (PRIOR ART)
FIG. 2B is an elevational view of a feeding device generally known to the prior art.
Figure 2A:
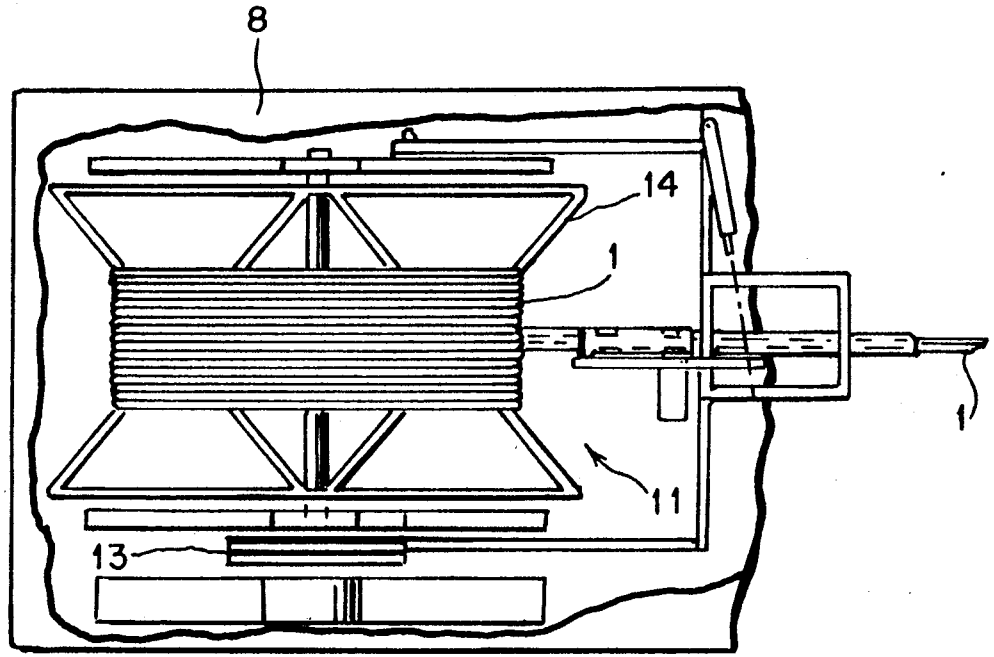
FIG. 2A is a top view of the retractable feeding device of FIG. 2 for use as a part of the present invention.

FIG. 2A is a top view of retractable feeding device (11) within box element (8), a top portion of box element (8) being shown as broken away for a better view of the feeding device. Feeding device (11) retains hose (1) on a conventional reel (14). The construction of the feeding device may be conventional in nature and may be of the type illustrated in FIG. 2B, which is disclosed in Homburg, French Patent No. 2,443,293, made of record in the inventor's parent application, Ser. No. 07/852,139. The prior art feeding device (20) of FIG. 2B includes a retraction mechanism (22) which may be manually-operated by rotating handle (24).

FIG. 3 is a prospective view of the operating tube (2) of the present invention with a plurality of hoses (1) being disposed therein. Operating tube (2) is shown as being hand-held by operator (6).

FIG. 4 is an elevational view, in partial cross-section, showing the operating tube (2) of the present invention with a single hose (1) being disposed therein and means (30) for a backward flow of fluid, the operating tube being formed with a pistol-shaped handle. The backward flow is shown as being achieved via a channel which surrounds hose (1) within operating tube (2).

FIG. 5 is an elevational view, in partial cross-section, of the operating tube (2) of the present invention having a chuck (32) for mounting the operating tube onto the front inlet of a pipe (4) of a heat exchanger for cleaning the interior thereof. Chuck (32) is constructed so that is abuts the inlet of the front of pipe (4) and partially extends into the interior thereof.

FIG. 6 is a cross-sectional view of the chuck (32) of FIG. 5 taken along the 6—6 line showing chuck (32) to be comprised of various struts, rather than a solid element.

Figure 7:
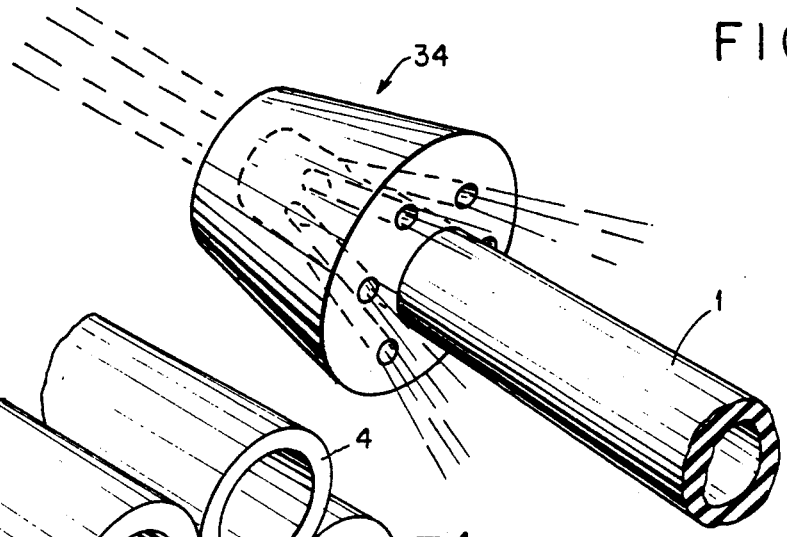
FIG. 7 is a prospective view of the outlet nozzle of the hose constructed in a manner whereby it is capable of a backward flow.

FIG. 7 is a prospective view of the outlet nozzle (34) of hose (1) constructed in a manner whereby it is capable of a backward flow. Outlet nozzle (34) is clearly shown as including several openings for a backward flow of fluid from the exchange pipes (4) being cleaned.

FIG. 8 is a prospective view of the operating tube (2) of the present invention having within it a plurality of hoses (1) and a plurality of straddling dowels (36) for securing the operating tube and hoses relative to the pipes (4) of the heat exchanger (5) to be cleaned.

Finally, FIG. 9 is a prospective view of an outlet nozzle (38) for retaining a plurality of hoses (1) with the nozzle having a construction which permits a backward flow though channels (40).

While only several embodiments of the present invention have been shown and described, it will be obvious to those of ordinary skill in the art that many modifications may be made to the present invention without departing from the spirit and scope thereof.

What is claimed is:

1. Apparatus for cleaning the inside of pipes in a heat exchanger, comprising:

an aggregate including the provision of high-pressurized water and, at least, one hose leading from said aggregate for directing the high-pressurized water, said hose being wound around a reel or feeding device in said aggregate when in a non-operational mode;

an operating tube for at least partially containing said hose and being suitable for handling during operation by a user and for directing the high-pressurized water emitted from said hose;

a flexible guide hose being located between said reel of said aggregate and said operating tube; and, a mounting device for fixing said operating tube in all directions on a frontal side of at least one pipe of the heat exchanger.

2. Apparatus for cleaning the inside of pipes in a heat exchanger according to claim 1, wherein said hose of said aggregate is provided with an outlet nozzle having channel means for a backward flow.

3. Apparatus for cleaning the inside of pipes in a heat exchanger according to claim 1, wherein said mounting device is a plurality of straddling dowels.

4. Apparatus for cleaning the inside of pipes in a heat exchanger according to claim 1, wherein said operating tube is formed in the shape of a pistol for allowing easier handling by a user.

5. Apparatus for cleaning the inside of pipes in a heat exchanger according to claim 1, wherein a plurality of hoses are disposed parallel to one another in said operating tube.

6. Apparatus for cleaning the inside of pipes in a heat exchanger according to claim 5, further comprising means for varying relative distances between said hoses in said operating tube.

7. Apparatus for cleaning the inside of pipes in a heat exchanger according to claim 1, wherein said feeding device is retractable and operable pneumatically.

* * * * *